US006238208B1

(12) United States Patent
Yoshida et al.

(10) Patent No.: US 6,238,208 B1
(45) Date of Patent: May 29, 2001

(54) METHOD AND APPARATUS FOR COOLING FURNACE

(75) Inventors: Masaharu Yoshida; Tsuguhiko Nakagawa, both of Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/242,922

(22) PCT Filed: Jun. 26, 1998

(86) PCT No.: PCT/JP98/02873

§ 371 Date: Feb. 26, 1999

§ 102(e) Date: Feb. 26, 1999

(87) PCT Pub. No.: WO99/00633

PCT Pub. Date: Jan. 7, 1999

(30) Foreign Application Priority Data

Jun. 30, 1997 (JP) ..... 9-174892
Jun. 30, 1997 (JP) ..... 9-174893

(51) Int. Cl.[7] ..... F28G 5/00
(52) U.S. Cl. ..... 432/2; 432/4; 432/75
(58) Field of Search ..... 122/379, 380, 122/390; 432/4, 2, 75, 77, 1, 81, 128; 373/77, 110, 113

(56) References Cited

U.S. PATENT DOCUMENTS 4,945,862 * 8/1990 Vadakin ..... 122/392
5,305,713 * 4/1994 Vadakin ..... 122/391
5,564,371 * 10/1996 Ashton et al. ..... 122/392
5,579,726 * 12/1996 Finucane ..... 122/379
5,741,130 * 4/1998 Hagstrom et al. ..... 432/2

FOREIGN PATENT DOCUMENTS 50-86408 7/1975 (JP) .
53-45049 10/1978 (JP) .
62-136518 6/1987 (JP) .
63-28817 2/1988 (JP) .
2-52985 2/1990 (JP) .
4-280913 10/1992 (JP) .
B2-7-62169 7/1995 (JP) .

* cited by examiner

*Primary Examiner*—Jiping Lu
(74) *Attorney, Agent, or Firm*—Oliff & Berridge, PLC

(57) ABSTRACT

A method for cooling the heating furnace during the dormant stage of the heating furnace; said method surely and sufficiently shortens the cooling time of the heating furnace irrespective of seasons such as summer or winter, and yet, without damaging the inner furnace refractories. Furthermore, the method is applicable to ceramic fiber furnaces. The method comprises: inserting, from an extracting port to the inside of the heating furnace, a plurality of lances being arranged along the width direction of the extracting port of said furnace while taking a predetermined distance between each other; and spraying, from a plurality of spray nozzles provided on the lances, a coolant in the form of a mist against a scale deposited inside the heating furnace. Optionally, a cooling fan is provided to forcibly supply a cooling air into the heating furnace.

10 Claims, 13 Drawing Sheets

EXTRACTING PORT SIDE

EXTRACTING PORT SIDE

METHOD AND APPARATUS FOR COOLING FURNACE

TECHNICAL FIELD

The present invention relates to a method and to an apparatus for heating furnace, which enable cooling a heating furnace in a short period of time and which are used in hot rolling steel materials, for example, slabs, billets, blooms, etc.

BACKGROUND OF THE INVENTION

The reduction of cooling time, i.e., the time necessary for cooling a heating furnace when it is dormant due to either an accident or a regular inspection, is an important point in increasing efficiency of an installation for rolling steel materials.

For a conventional heating furnace for use in hot rolling, JP-A-Sho50-86408 and JP-A-Hei4-280913 (the term "JP-A-" as referred herein signifies an "unexamined published Japanese Patent application") disclose that it is necessary to lower the temperature to ambient temperature before allowing an operator to enter into the heating furnace, and that the cooling time usually takes from about 24 hours to a period of from about 4 to 6 days. However, the details of the method for cooling the heating furnace are not disclosed. Probably, air cooling using a cooling fan described below is employed. The cooling method conventionally employed by the present inventors comprises air cooling alone at a cooling air flow rate of from 70,000 to 80,000 $Nm^3/Hr$, which corresponds to the total of the air produced by a cooling fan taken from the extraction port of the heating furnace and the cooling air from burners. If the scale deposited inside the furnace has a large heat accumulation (and particularly, in case the soaking zone has a large heat accumulation), the scale deposited inside the furnace could not be readily cooled, and it requires 2 or 3 days, or a period even longer, to cool the furnace itself.

In JP-A-Sho63-28817 is disclosed a technology which comprises rapidly cooling the furnace body of a converter immediately after discharging steel, thereby allowing quick thickness measurement of the refractories which make the inner wall of the furnace body. More specifically, it comprises quenching the bricks by directly blowing a water mist to the refractories inside the converter. Furthermore, fire resistant materials are added into the mist to prevent spalling from occurring on the bricks constituting the inner wall of the furnace. However, the method described in this reference comprises spray cooling a particular portion that is thereafter subjected to the thickness measurement of the refractories. Thus, this is a non-uniform cooling by means of a partial forced cooling, and damage is suspected to occur due to thermal stress. Moreover, the method of this reference is not a technology related to the cooling of a heating furnace for use in hot rolling. That is, it does not relate to a method for cooling the scale deposited inside the furnace, nor to a method or apparatus for rapidly cooling the entire heating furnace over a large area.

JP-A-Sho62-136518 refers to a method and an apparatus for removing the scale deposited on a skid of a walking beam type heating furnace by using a highly compressed air. It comprises a plurality of air nozzles arranged in correspondence with the skids along the width direction of the furnace, which are moved in the longitudinal direction of the furnace by using a walking beam. However, only air piping are provided in this case because this technique does not relate to a technique for cooling the furnace.

Thus, to overcome the aforementioned problems, there is proposed a method which comprises increasing the number of cooling fans that are set on the extracting port side, thereby increasing the total rate of cooling air (i.e., to 200,000 $Nm^3/Hr$ or higher) inclusive of the air provided from the burner, or a method which comprises spraying a coolant against the scale deposits that are formed inside the furnace.

Still, however, the method which comprises increasing total flow rate of cooling air by increasing the number of cooling fans provided on the extracting port side suffers a problem as such that seasonal factors greatly influence the cooling power. More specifically, a limit has been found in shortening the cooling time in summer seasons, because the temperature of the cooling air remain high in summer. On the other hand, the method of spraying a coolant against the scale deposits that are formed inside the furnace has found that damages occur on the refractories because water is scattered over the refractories when the refractories are still at high temperatures. To circumvent such damages from occurring, water must be sprayed only after the inner furnace temperature is lowered to a sufficiently low level, and this requires a long waiting time which, as a result, makes it impossible to shorten the cooling time to a satisfactory level.

The present invention has been achieved with an aim to overcome the aforementioned disadvantages, and an object of the present invention is to provide a method and an apparatus for cooling a heating furnace, which surely shortens the cooling time of the furnace irrespective of seasonal conditions and yet, without damaging the refractories inside the furnace.

DISCLOSURE OF THE INVENTION

The objects above had been achieved by the present invention. Thus, in accordance with a first aspect of the present invention, there is provided a method for cooling a heating furnace, which is a method for cooling the heating furnace during the dormant stage thereof, comprising: inserting from an extracting port to the inside of the heating furnace, a plurality of lances being arranged along the width direction of the extracting port of said furnace while taking a predetermined distance between each other; and spraying a coolant in the form of a mist against a scale deposited inside the heating furnace from a plurality of spray nozzles provided on the lances.

According to a second aspect of the present invention, there is provided a method for cooling a heating furnace as described in the first aspect, wherein, an additional cooling air is forcibly supplied to the inside of said heating furnace together with the spraying of the coolant in the form of a mist against the scale.

In accordance with a third aspect of the present invention, there is provided a method for cooling a heating furnace as described in the first and the second aspects above, wherein, said heating furnace is a type in which the material to be heated is transported by using fixed beams and walking beams both extended in the longitudinal direction of the furnace and arranged in turns while taking a predetermined distance between each other; a frame on which said plurality of spray nozzles are provided is inserted into the inside of the heating furnace from the extracting port and mounted on said beams; and said walking beams are driven in such a manner to move said frame reciprocally along the longitudinal direction of the furnace while the coolant in the form of a mist is sprayed from said spray nozzles against the scale deposited inside the furnace.

According to a fourth aspect of the present invention, there is provided an apparatus for cooling a heating furnace, which is an apparatus for cooling the heating furnace during the dormant stage thereof, comprising: a basement placed in the vicinity of an extracting port of said heating furnace; a plurality of lances each having a length not interfering the extracting port when they are rotated, and provided arranged along the width direction of the extracting port of said furnace while taking a predetermined distance between each other; a support portion for said lance which supports the lance on said basement in such a manner that the base end portion of said lance is movable in the horizontal direction and rotatable; a plurality of spray nozzles provided arranged in the longitudinal direction of the outer periphery of said lances, which spray a coolant in the form of a mist against the scale deposited inside the furnace; and a spray coolant supply means which supplies to said lances, the coolant at a predetermined pressure and a compressed air at a predetermined pressure.

In accordance with a fifth aspect of the present invention, there is provided an apparatus for cooling a heating furnace as described in the fourth aspect, wherein, an additional cooling fan which supplies a cooling air to the inside of said heating furnace through said extracting port is provided on said basement.

In accordance with a sixth aspect of the present invention, there is provided an apparatus for cooling a heating furnace as described in the fourth or the fifth aspect of the present invention, wherein at least three of said lances are provided, such that: the lances placed on the both side ends taken on the width direction of said extracting port are denoted as the outer lances, which are attached to said basement via said support portions for lances in such a manner that the lances are rotatable in the horizontal direction; the lances placed on the inner side taken on the width direction of said extracting port are denoted as the inner lances, which are attached to said basement via said support portion for lances, such that the base end portions thereof are provided farther from the extracting port as compared with the position at which the base end portions of the outer lances are attached, and are provided rotatable in the horizontal direction; and a guide portion is provided, said guide portion guiding the lance support portions for the inner lances along the width direction of the extracting port, and at the same time, guiding them in a direction approaching the extracting port at a predetermined position in said with direction.

In accordance with the seventh to the ninth aspects of the present invention, there are provided each a method for cooling a heating furnace, wherein, the coolant provided in the form of a mist consists of sprayed particles having a particle diameter of 100 $\mu$m or less; or furthermore, the particle diameter of the sprayed particles of the coolant provided in the form of a mist is controlled in accordance with the following formula (1):

$$D \leqq 61.255 \cdot 1n\ T - 214.24 \quad (1)$$

where, D represents the particle diameter of the sprayed particles ($\mu$m) , and T represents the temperature of the atmosphere inside the furnace (° C.). In addition, there is provided a method in which the particle diameter of the sprayed particles of the coolant provided in the form of a mist is reduced with decreasing temperature inside the furnace.

According to a tenth aspect of the present invention, there is provided a method for cooling a heating furnace as described in the second aspect of the present invention, wherein, the concentration of water vapor inside the furnace is controlled to 30 vol % or lower.

According to the eleventh and the twelfth aspects of the present invention, there are provided a method and an apparatus for cooling a heating furnace, characterized in that the heating furnace is a furnace for hot rolling slabs, billets or blooms.

BEST MODE FOR CARRYING OUT THE INVENTION

Figure 1:
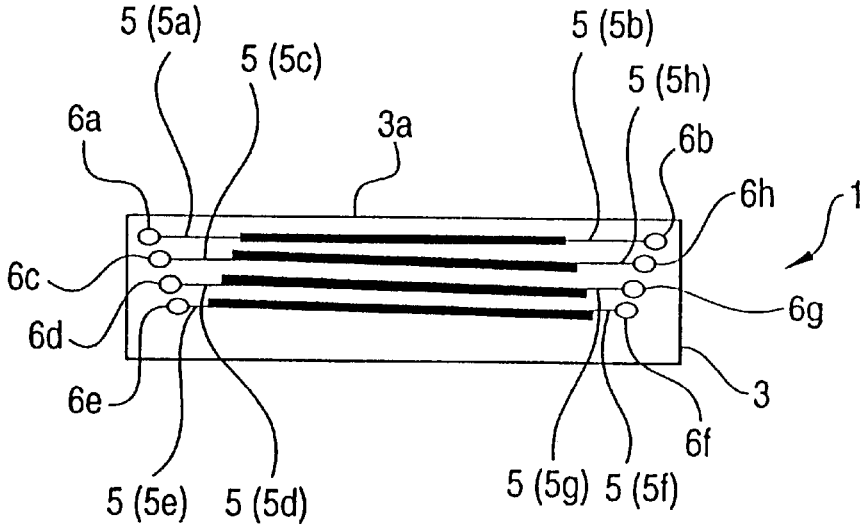
FIGS. 1(A) and 1(B) are each a planar view of the stage in which the lances of the cooling apparatuses are shut, each according to an example of a first and a second embodiment of the method for cooling a heating furnace in accordance with the present invention.
Figure 1:
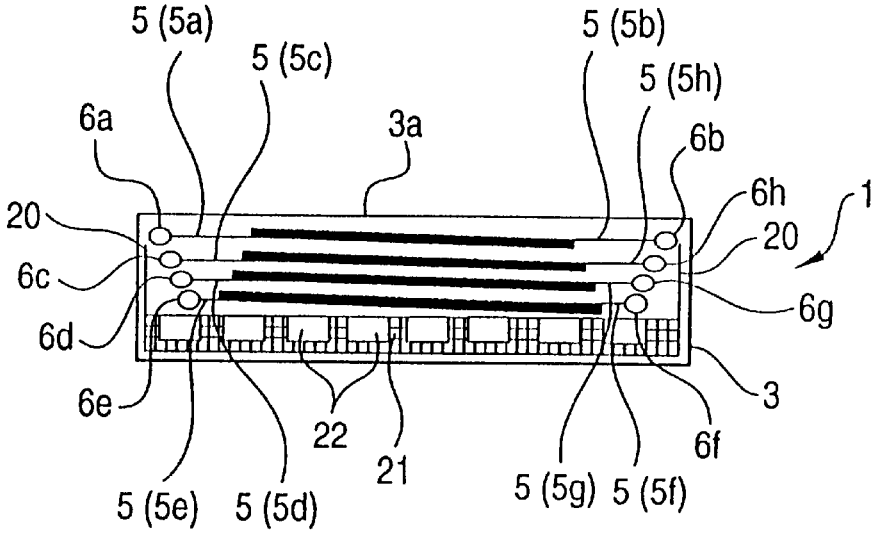
Figure 2:
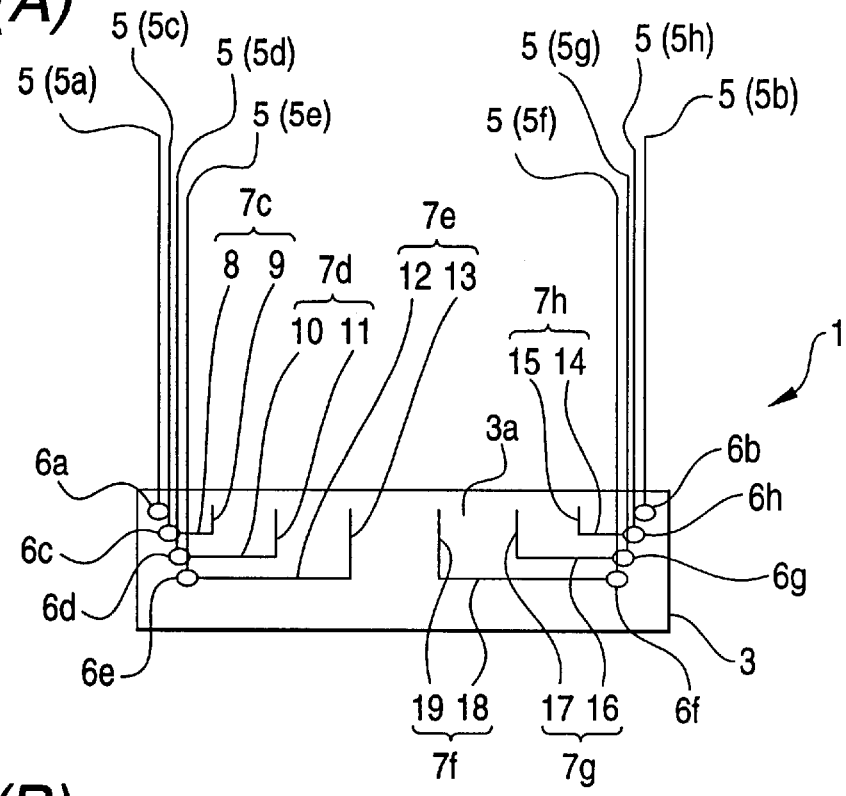
FIGS. 2(A) and 2(B) are each a planar view of a stage in which the lances of the cooling apparatus are open, each provided as an explanatory diagram of an example of a first and a second embodiment of the method for cooling a heating furnace in accordance with the present invention.
Figure 2:
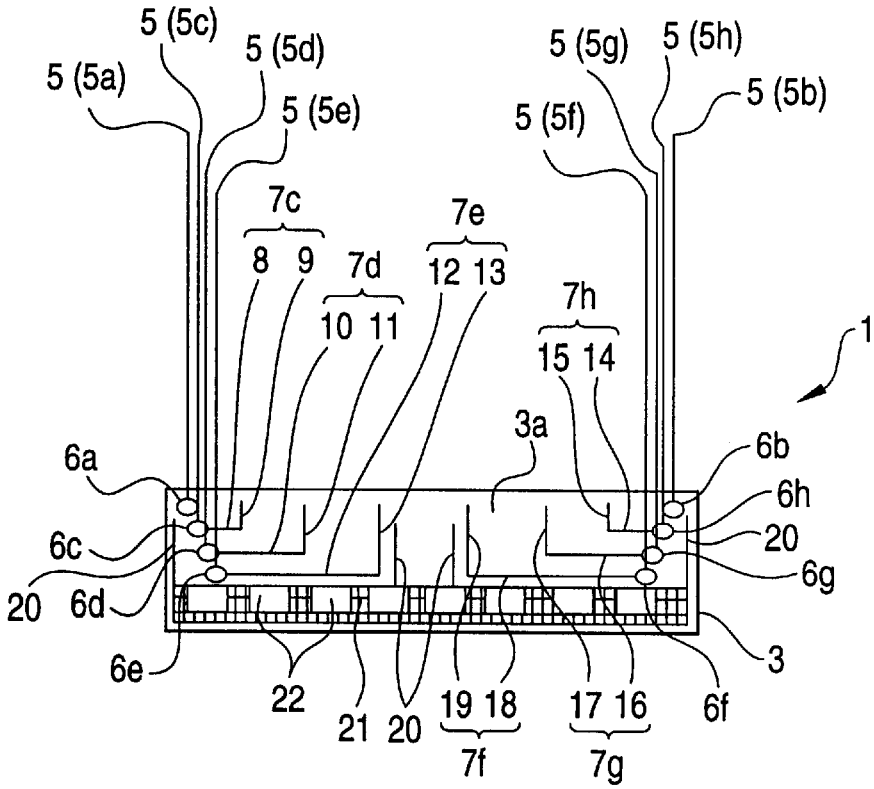
Figure 3:
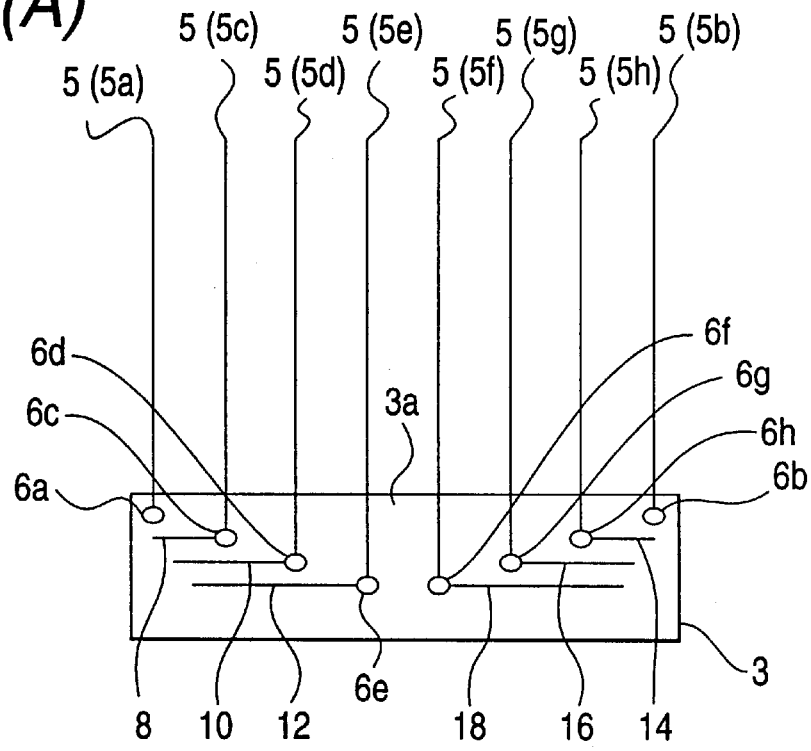
FIGS. 3(A) and 3(B) are each a planar view of a stage in which the lances of the cooling apparatus are arranged approximately equidistant from each other by moving them in the width direction of the extracting port, each provided as an explanatory diagram of an example of a first and a second embodiment of the method for cooling a heating furnace in accordance with the present invention.
Figure 3:
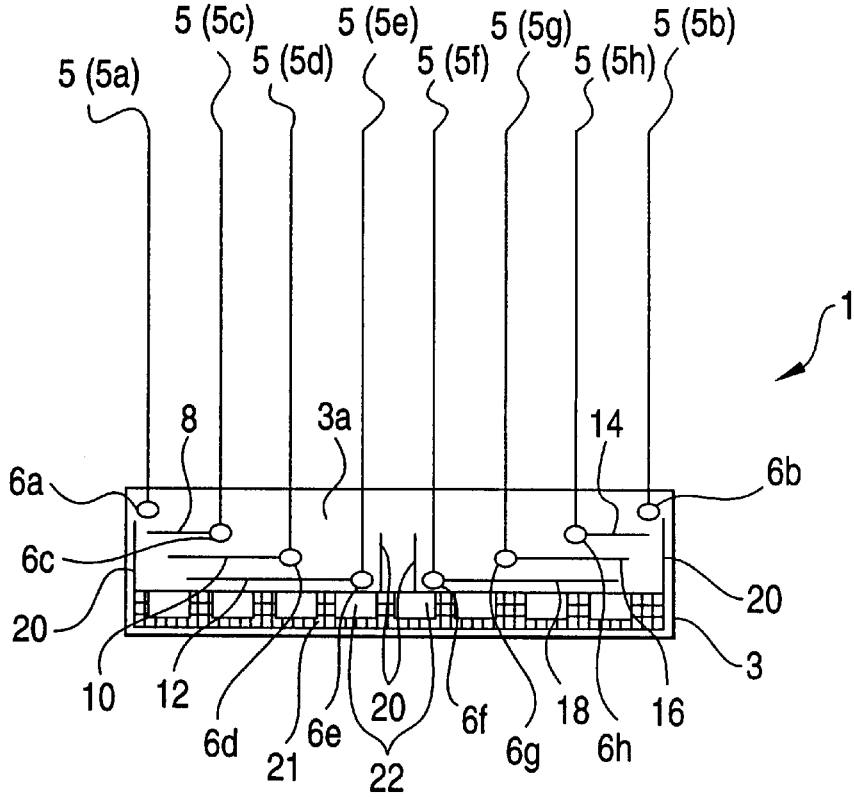
Figure 4:
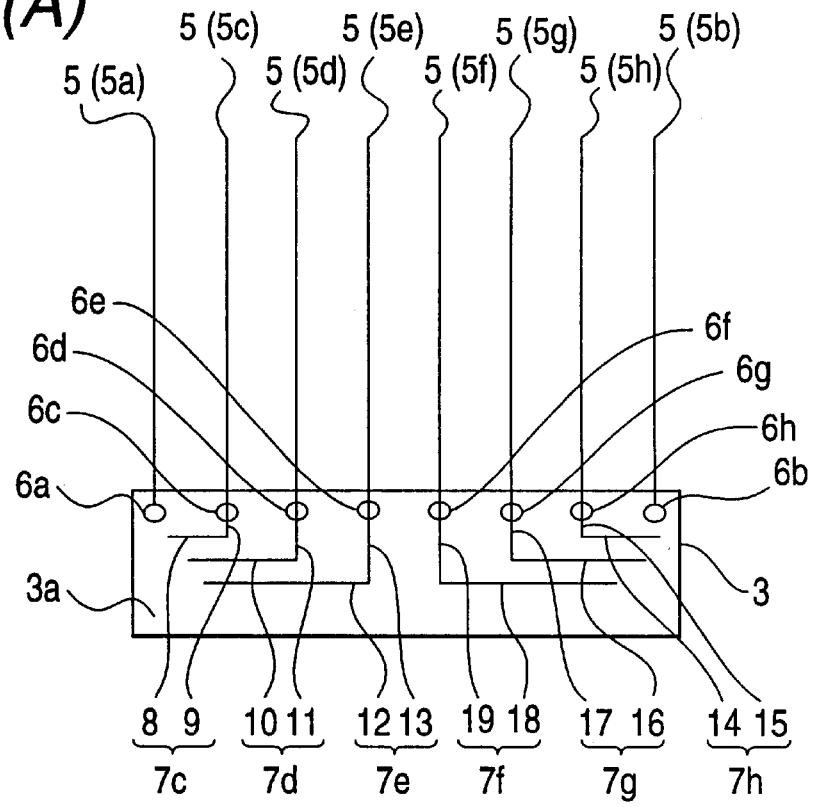
FIGS. 4(A) and 4(B) are each a planar view of a stage in which the lances of the cooling apparatus are arranged in such a manner that the front end thereof are lined by moving them in the direction approaching the extracting port, each provided as an explanatory diagram of an example of a first and a second embodiment of the method for cooling a heating furnace in accordance with the present invention.
Figure 4:
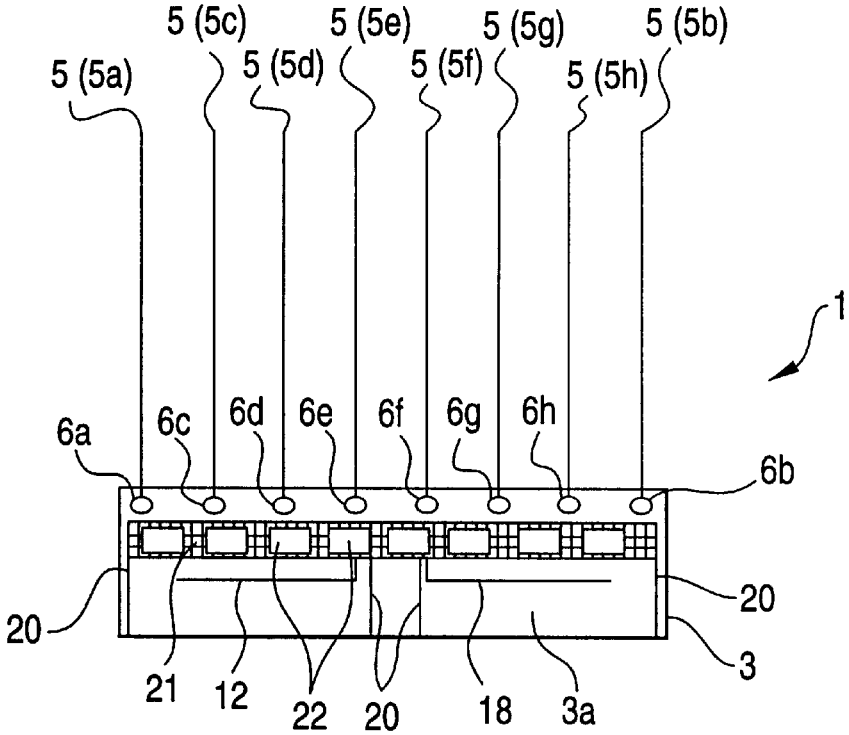
Figure 5:
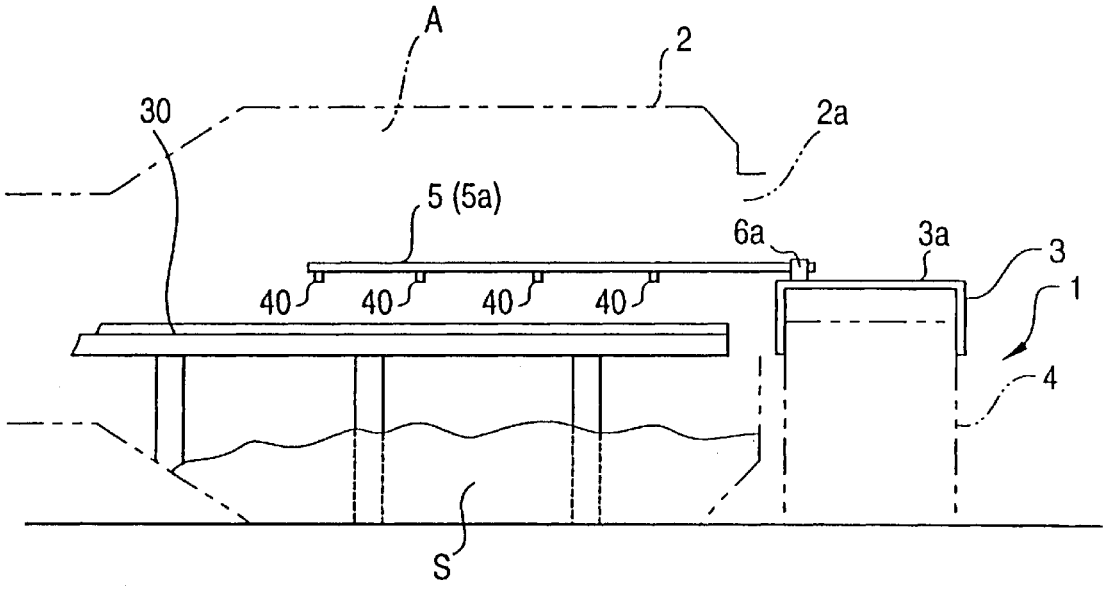
FIGS. 5(A) and 5(B) are each a side view of a stage in which the cooling apparatuses are installed on the extracting port side of the heating furnace, each provided as an example of a first and a second embodiment of the method for cooling a heating furnace in accordance with the present invention.
Figure 5:
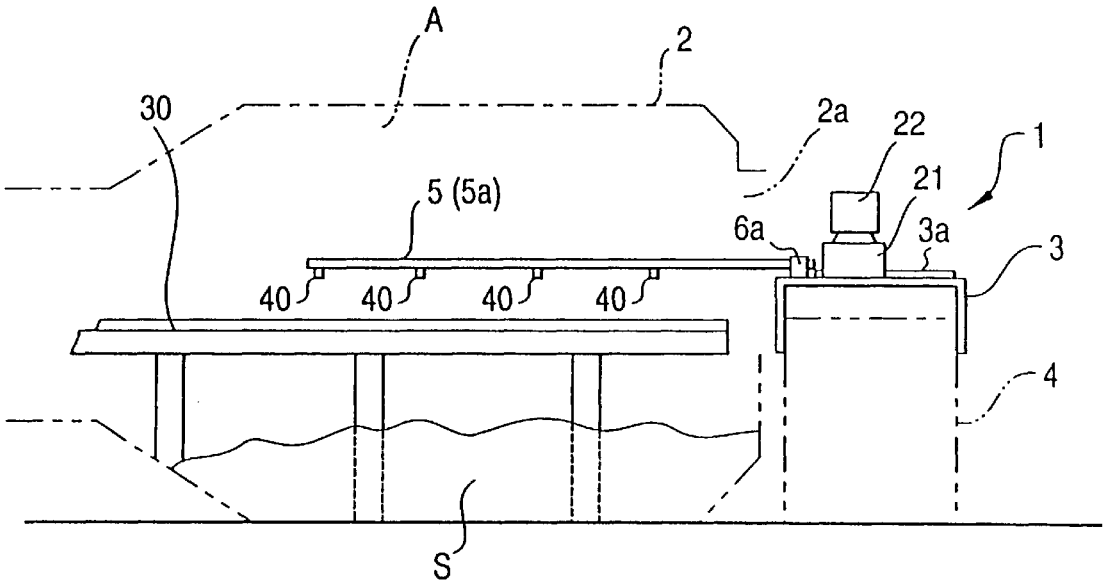
Figure 6:
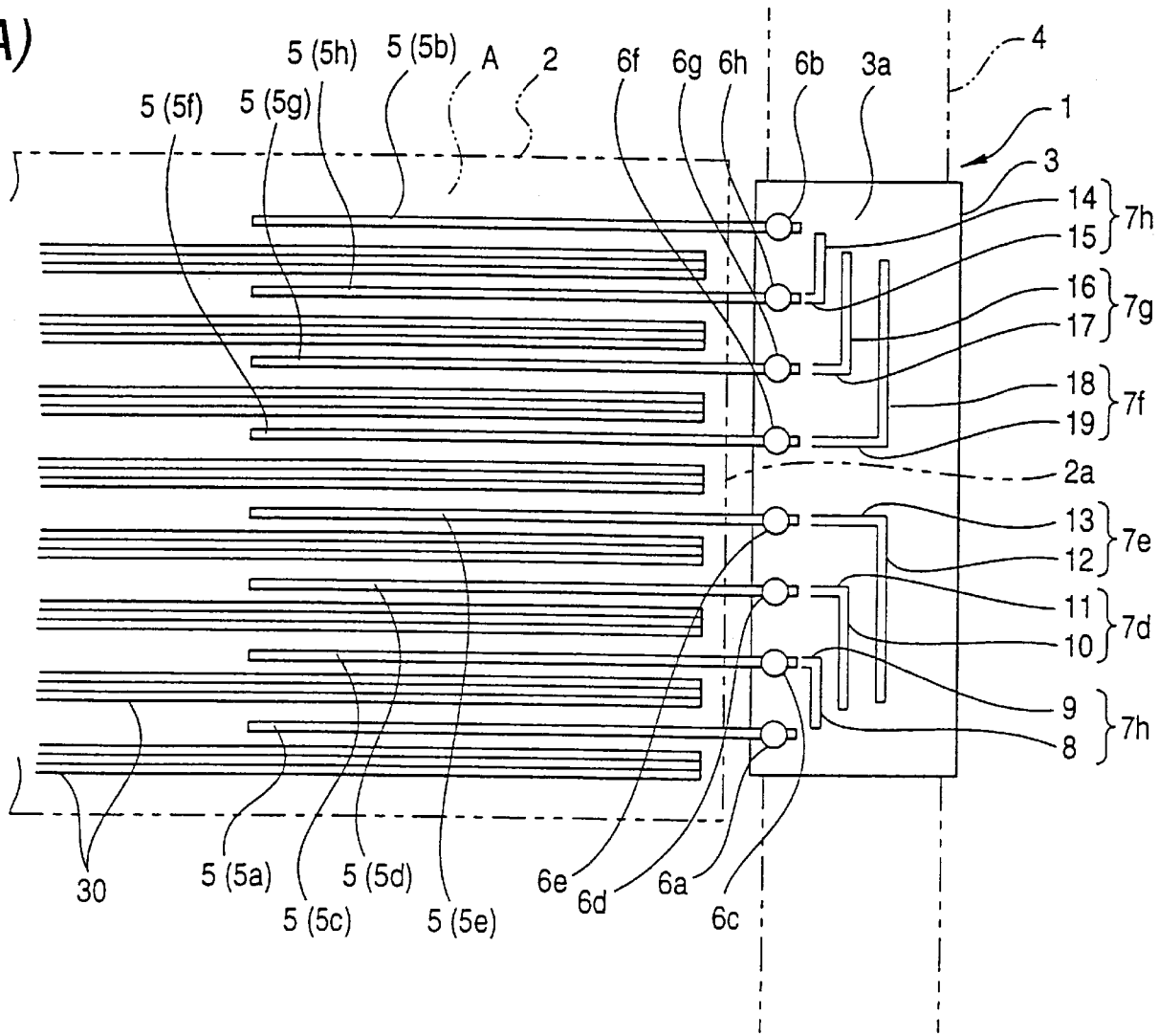
FIGS. 6 (A) and 6 (B) are each a planar view corresponding to FIGS. 5(A) and 5(B)
Figure 6:
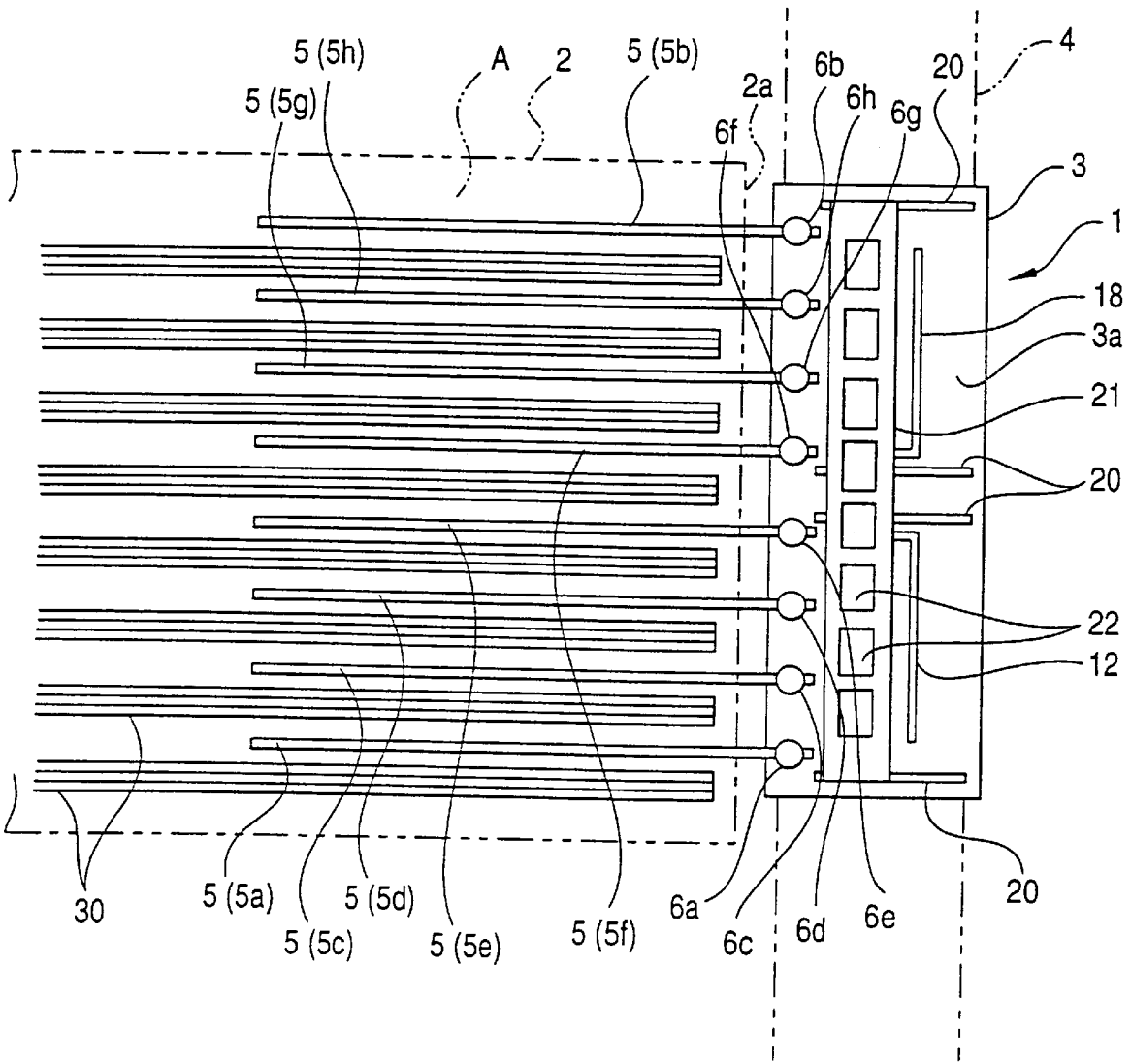

An embodiment according to the present invention is described below by making reference to the attached drawings.

A cooling apparatus 1 is described below by referring to FIG. 1(A) through FIG. 6(B). The cooling apparatus 1 is equipped with a basement 3 placed in the vicinity of an extracting port 2*a* of a heating furnace 2.

The basement 3 is attached to a table or the like of a rolling line 4 provided along the width direction of the extracting port 2*a* in the vicinity of said extracting port 2*a*, and in the position upper to the rolling line 4, it has a long setting plane 3*a* extended along the width direction of the extracting port 2*a*. Referring to FIGS. 4(A) and 4(B) as well as to FIGS. 6(A) and 6(B), a plurality (specifically, 8 units in this case) of lances 5 are provided approximately equally spaced on the setting plane 3*a* along the width direction of the extracting port 2*a*. The lances 5 are each provided linearly at a length shorter than the length of the extracting port 2*a* taken in the width direction. Thus, the lances do not interfere the extracting port 2*a* in case they are rotated as described hereinafter.

A plurality (specifically in this case, 4 units) of spray nozzles 40 for spraying cooling water as a mist against the scale S deposited in the soaking zone A are provided approximately equi-spaced on the lower portion of the peripheral direction of the lances 5. Cooling water and compressed air are each supplied at a predetermined pressure to each of the lances 5 from a means for supplying coolant not shown in the figure. By thus supplying the coolants, cooling water is sprayed in the form of a mist from the spray nozzles 40. Furthermore, among the plurality of spray nozzles 40, the one placed on the foremost is inclined toward the front end in such a manner to enlarge the spray area.

Referring to the plurality of lances 5, the base ends of the two lances 5 placed on both sides in the width direction of the extracting port 2*a* (referred to hereinafter as outer lances 5*a* and 5*b*) are supported rotatable in the horizontal direction via the lance support portions 6*a* and 6*b* fixed to the setting plane 3*a*.

On the other hand, the base ends of the remaining six lances 5 (referred to hereinafter as inner lances 5*c*, 5*d*, 5*e*, 5*f*, 5*g*, and 5*h*, in the order of approaching the outer lance 5*b*) are supported rotatable in the horizontal direction via the lance support portions 6*c* to 6*h* provided movable on the setting plane 3*a*.

The lance support portions 6*c* to 6*h* are set movable along guide rails (guide portions) 7*c* to 7*h* provided on the setting plane 3*a* of the basement 3, in correspondence with the lance support portions 6*c* to 6*h* (see FIGS. 2(A) and 2(B)).

The guide rail 7*c* is equipped with a lateral rail 8, which stretches, on the back side of the lance support portion 6*a* (i.e., the side farther from the extracting port 2*a*), for a length corresponding to the distance between the outer lance 5*a* and the inner lance 5*c* from the base end corresponding to a position slightly approached from the lance support portion 6*a* to the center of the width direction of the basement 3, and a longitudinal rail 9 which extends from the front end portion of the lateral rail 8 towards the direction approaching the extracting port 2*a*. The guide rail 7*d* is equipped with a lateral rail 10 and a longitudinal rail 11; said lateral rail 10 is such which stretches from, on the back side of the base end of the lateral rail 8 (i.e., the side farther from the extracting port 2*a*), the base end corresponding to a position slightly approached from the base end of the lateral rail 8 to the center of the width direction of the basement 3, for a length corresponding to the total distance obtained by adding the distance between the base end and the front end of the lateral rail 8 approached to the center of the width direction of the basement 3 and the distance between the inner lance 5*c* and the inner lance 5*d*, and the longitudinal rail 11 extends from the front end portion of the lateral rail 10 towards the direction approaching the extracting port 2*a*. The guide rail 7*e* is equipped with a lateral rail 12 and a longitudinal rail 13; said lateral rail 12 is such which stretches from, on the back side of the base end of the lateral rail 10 (i.e., the side farther from the extracting port 2*a*), the base end corresponding to a position slightly approached from the base end of the lateral rail 10 to the center of the width direction of the basement 3, for a length corresponding to the total distance obtained by adding the distance between the base end and the front end of the lateral rail 10 approached to the center of the width direction of the basement 3 and the distance between the inner lance 5*d* and the inner lance 5*e*, and the longitudinal rail 13 extends from the front end portion of the lateral rail 12 towards the direction approaching the extracting port 2*a*.

Furthermore, the guide rail 7*h* is equipped with a lateral rail 14, which stretches, on the back side of the lance support portion 6*b* (i.e., the side farther from the extracting port 2*a*), for a length corresponding to the distance between the outer lance 5*b* and the inner lance 5*h* from the base end corresponding to a position slightly approached from the lance support portion 6*b* to the center of the width direction of the basement 3, and a longitudinal rail 15 which extends from the front end portion of the lateral rail 14 towards the direction approaching the extracting port 2*a*. The guide rail 7*g* is equipped with a lateral rail 16 and a longitudinal rail 17; said lateral rail 16 is such which stretches from, on the back side of the base end of the lateral rail 14 (i.e., the side farther from the extracting port 2*a*), the base end corresponding to a position slightly approached from the base end of the lateral rail 14 to the center of the width direction of the basement 3, for a length corresponding to the total distance obtained by adding the distance between the base end and the front end of the lateral rail 14 approached to the center of the width direction of the basement 3 and the distance between the inner lance 5*h* and the inner lance 5*g*, and the longitudinal rail 17 extends from the front end portion of the lateral rail 16 towards the direction approaching the extracting port 2*a*. The guide rail 7*f* is equipped with a lateral rail 18 and a longitudinal rail 19; said lateral rail 18 is such which stretches from, on the back side of the base end of the lateral rail 16 (i.e., the side farther from the extracting port 2*a*), the base end corresponding to a position slightly approached from the base end of the lateral rail 16 to the center of the width direction of the basement 3, for a length corresponding to the total distance obtained by adding the distance between the base end and the front end of the lateral rail 16 approached to the center of the width direction of the basement 3 and the distance between the inner lance 5*g* and the inner lance 5*f*, and the longitudinal rail 19 extends from the front end portion of the lateral rail 18 towards the direction approaching the extracting port 2*a*.

The positions of the front ends of the longitudinal rails 19, 17, 15, 13, 11, and 9 each approximately correspond to the fixed positions of the lance support portions 6*a* and 6*b* to the basement 3, and the distance between the longitudinal rail 13 and the longitudinal rail 19 corresponds to that between the inner lance 5*e* and the inner lance 5*f*.

Referring to FIGS. 1(B), 2(B), 3(B), 4(B), 5(B), and 6(B), a setting table 21 for the cooling fan is provided on the upper position of the lance 5, where a plurality (specifically in this case, 8 units) of cooling fans 22 which forcibly supply cooling air to the inside of the heating furnace 2 from the extracting port 2*a* are installed approximately equi-spaced in the width direction of the extracting port 2*a*. The setting table 21 for the cooling fan is provided movable in a reciprocating manner in the longitudinal direction of the furnace along the guide rail 20 provided on the setting plane 3*a* between the longitudinal rail 13 and the longitudinal rail 19, and on the setting plane 3*a* outside the lance support portions 6*a* and 6*b*.

Referring to FIGS. 1(A) and 1(B), the cooling apparatus 1 of a constitution described above comprises, before the use, each of the lances 5*a* to 5*h* in a state folded inside the width direction of the extracting port 2*a*. In such a state, the lance support portions 6*c* to 6*h* are each positioned at the corresponding base ends of the lateral rails 8, 10, 12, 14, 16, and 18, respectively.

Furthermore, as shown in FIGS. 1(B), 2(B), 3(B), 4(B), 5(B), and 6(B), the setting table 21 for the cooling fan is placed on the back side (the side distant from the extracting port 2*a*) of the lance support portions 6*c* to 6*h* so that it may not interfere the rotational operation of each of the lances 5*a* to 5*h*.

In using the cooling apparatus 1 in case the heating furnace 2 is dormant, firstly, as shown in FIGS. 2(A) and 2(B), each of the lances 5*a* to 5*h* are rotated on the side of the extracting port 2*a* in such a manner that the longitudinal directions thereof are headed to the longitudinal direction of the furnace. Then, the lances 5*a* to 5*h* are each inserted into the heating furnace 2 through the extracting port 2*a*. The length of the lances are set shorter than the width of the furnace so that the lances may not interfere the extracting port of the furnace when rotated.

Then, referring to FIGS. 3(A) and 3(B), the lance support portions 6*c* to 6*h* are each moved to the front ends of the lateral rails 8, 10, 12, 14, 16, and 18, so that the lances 5*a* to 5*h* can be arranged approximately equi-spaced in the width direction of the extracting port 2*a*.

In this stage, referring to FIGS. 5(A) and 5(B) as well as to FIGS. 6(A) and 6(B), the lances 5*a* to 5*h* are each provided on the upper position of a plurality of skid beams 30 provided inside the heating furnace 2, in an approximately equi-spaced arrangement in the width direction thereof and each interposed between the neighboring skid beams 30. The spray nozzles 40 of the lances 5*a* to 5*h* are each pointed to the scale deposits S on the soaking zone A.

Referring to FIGS. 4(A) and 4(B), the lance support portions 6*c* to 6*h* are each moved to the front ends of each of the longitudinal rails 9, 11, 13, 15, 17, and 19 to line the front ends of the lances 5*a* to 5*h*. The cooling apparatus 1 is now ready for use.

In case a cooling fan is used, as shown in FIG. 4(B), the table 21 for setting the cooling fan is moved forward along the guide rail 20 to set the cooling fan 22 near to the extracting port 2*a*. Thus, the cooling apparatus is now ready for use.

At this state, cooling water is supplied to each of the lances 5*a* to 5*h* by using the coolant supply means, and cooling water is sprayed in the form of a mist (consisting of spray particles having a diameter not larger than 100 μm) against the scale S deposited on the soaking zone A from the spray nozzles 40 each provided on the lances 5*a* to 5*h*.

Furthermore, in case a cooling fan is used, the cooling fan 22 is driven to forcibly supply a cooling air into the heating furnace 2, whereby the heating furnace 2 is cooled in such a manner that the concentration of the water vapor inside the furnace should not exceed 30 vol %.

Figure 10:
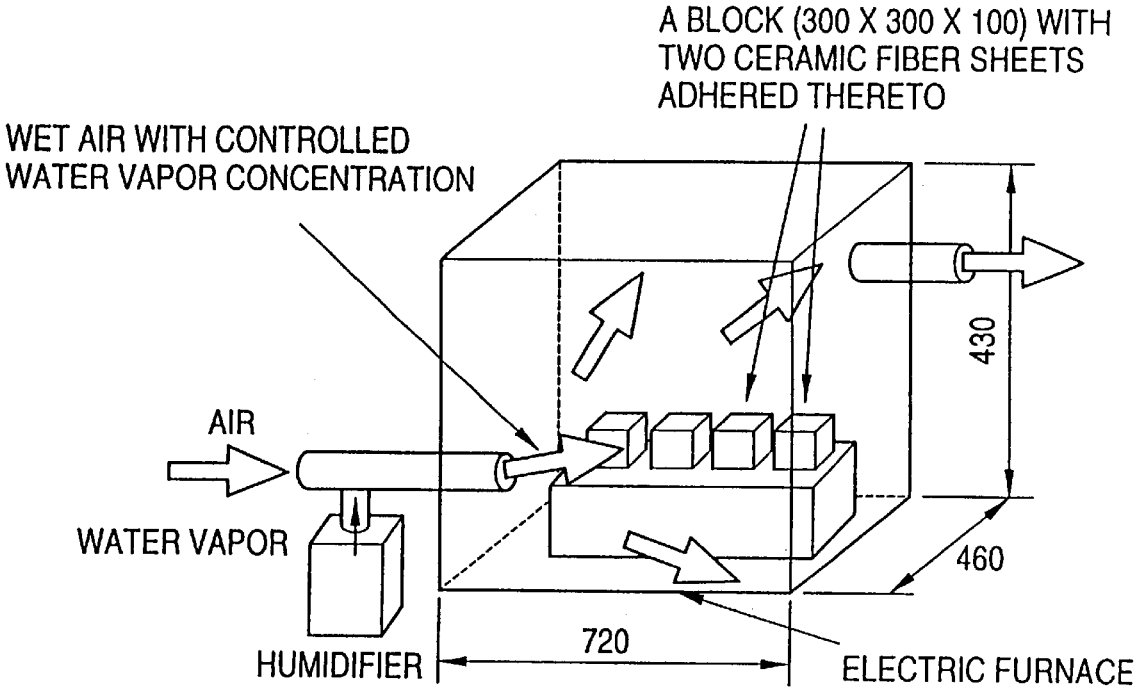
FIG. 10 is a schematically drawn diagram of an experimental apparatus to investigate the influence of water vapor on the adhesion strength of ceramic fibers.

FIG. 10 shows schematically an experimental apparatus for investigating the influence of water vapor on the adhesion strength of ceramic fibers. A block (300×300×100 mm) to which two ceramic fiber sheets are adhered was placed inside an electric furnace (460×720×430 mm), and wet air whose vapor concentration was controlled by using a humidifier was supplied to the inside of the electric furnace to examine the adhesion strength of the ceramic fibers. The experimental results are given in FIG. 11.

Figure 11:
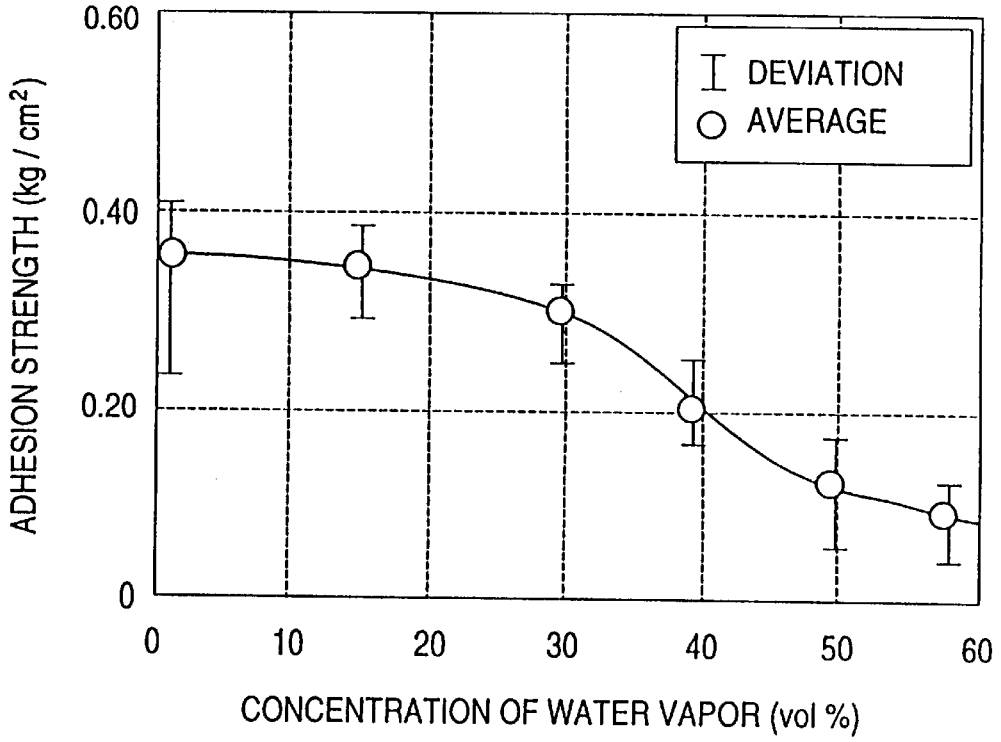
FIG. 11 is a graph which shows the relation between the concentration of water vapor and the adhesion strength of ceramic fibers.

Referring to FIG. 11, it can be understood that no problem occurs on the adhesion strength of the ceramic fibers so long as the water vapor concentration is maintained at 30 vol % or lower.

Figure 13:
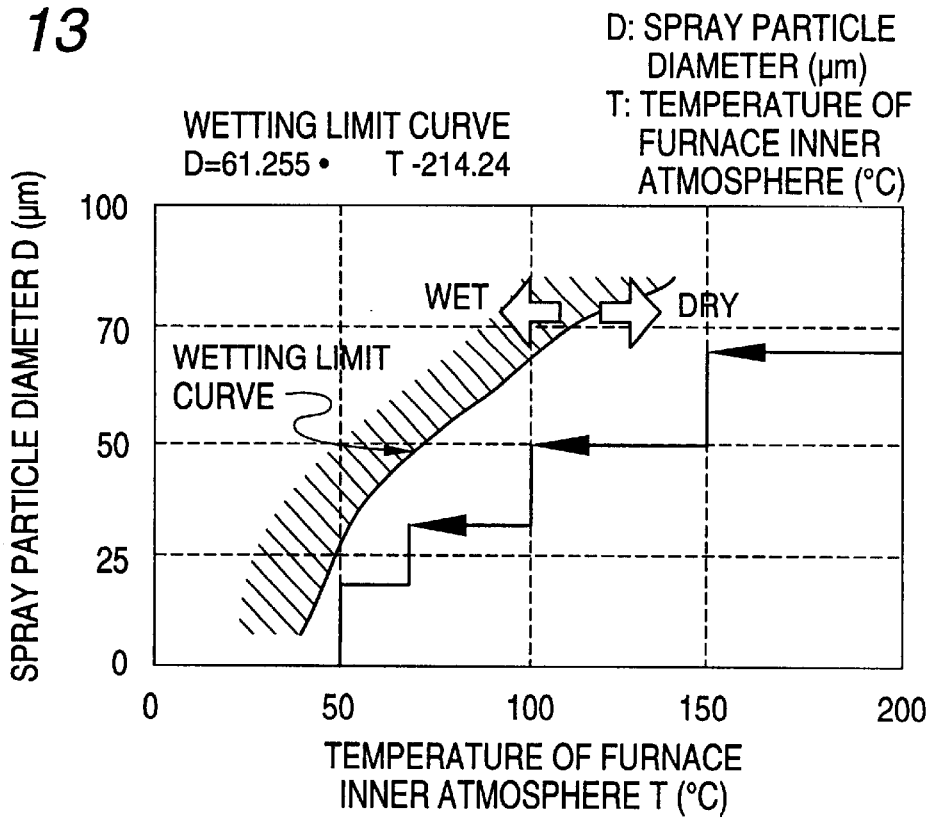
FIG. 13 is a diagram showing the relation between the temperature of the atmosphere inside the furnace and the diameter of the sprayed particles which do not wet the furnace wall, and an example of a spray cooling pattern according to the present invention.

FIG. 13 shows the relation between the temperature of the atmosphere inside the furnace T (° C.) and the particle diameter D (μm) of the sprayed particles at which the furnace wall does not get wet, and an example of a spray cooling pattern according to the present invention. The cooling power on the furnace is greater for a larger spray particle diameter D (equals to an increase in the amount of water), but because of a high dew point, the furnace wall begins to get wet at a temperature of the atmosphere inside the furnace T of 100° C. for a spray particle diameter D of 65 μm. The dew point is lowered with decreasing spray particle diameter D (equals to a decrease in the amount of water), and the wall furnace begins to get wet at a temperature of the atmosphere inside the furnace T of 50° C. in case the spray particle diameter D is 25 μm. Thus, to prevent damage on the refractories ascribed to the wetting of the furnace wall from occurring, the particle diameter is preferably controlled so that it may fall in a region defined by the side lower than the wetting limit curve shown in FIG. 13. More specifically, the particle diameter of the sprayed particles is controlled in accordance with the following formula (1):

$$D \leqq 61.255 \cdot 1n\ T - 214.24 \quad (1)$$

Furthermore, to cool the furnace more rapidly, for instance, as indicated by an arrow in FIG. 13, the cooling pattern is preferably controlled as such that the particle diameter of the sprayed particles become smaller with decreasing temperature of the atmosphere inside the furnace.

As is clear from the explanations above, the method according to the present embodiment comprises cooling the scale deposits S by spraying cooling water in the form of a mist to the scale S deposited inside the furnace. Thus, the cooling power is not subject to seasonal factors, and moreover, no wetting occurs on the inner furnace refractories.

Accordingly, even in case the temperature of the atmosphere inside the furnace is high, the scale deposits S can be cooled without waiting for the temperature of the atmosphere inside the furnace to drop. This is in contrast to a conventional method which required waiting time. Thus, as a result, the period of time necessary for cooling the furnace (the time necessary for cooling the furnace body and the time for cooling the surface of the scale deposits) can be surely shortened.

Furthermore, by supplying cooling air, the water vapor concentration inside the furnace can be reduced to 30 vol % or lower. Thus, this method can be favorably applied to ceramic fiber furnaces.

In the embodiment above, a case of fixing the basement 3 was referred to as an example. However, this is not requisite, and the basement 3 can be moved forward to or backward from the extracting port 2*a*.

Figure 7:
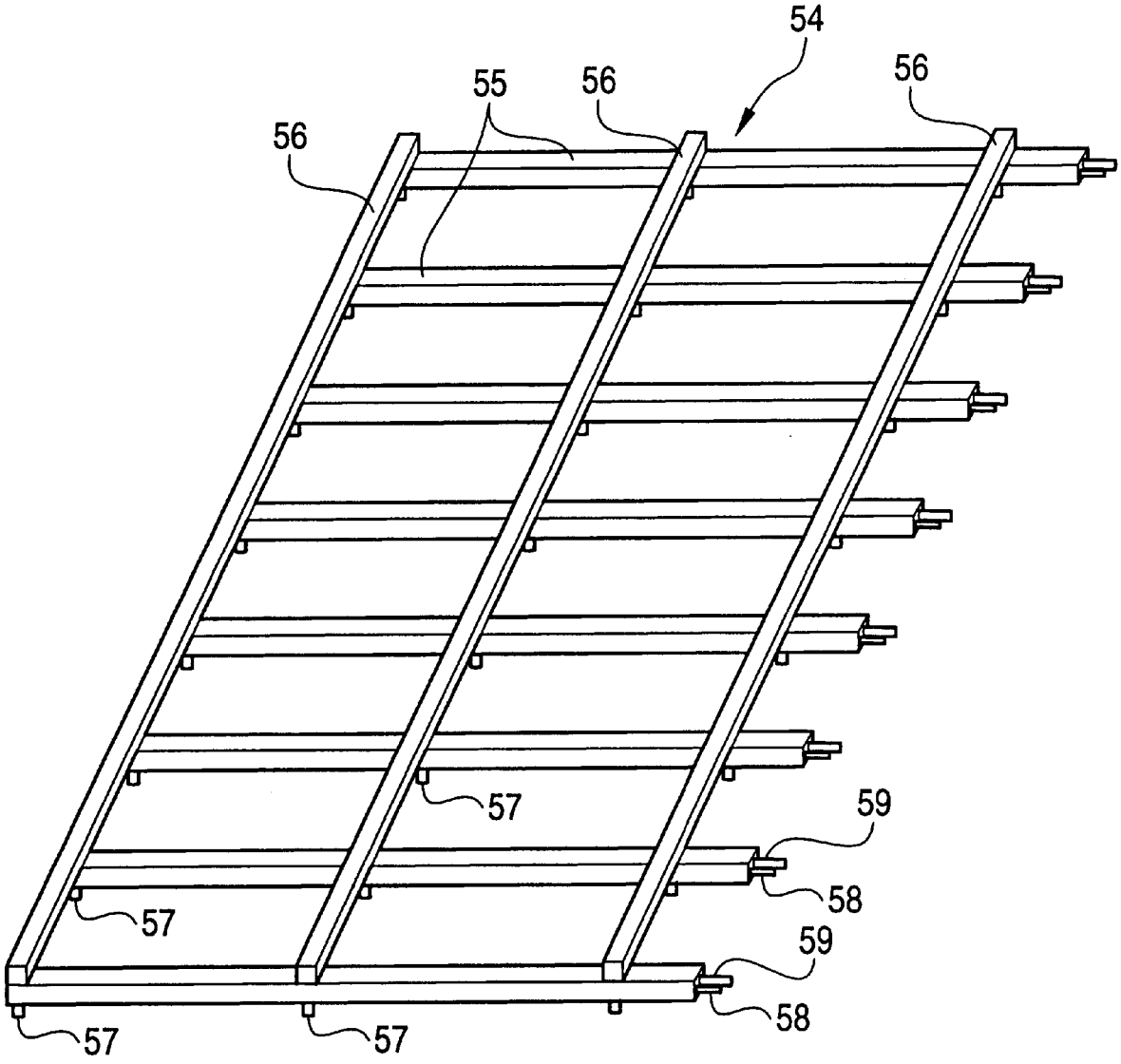
FIG. 7 is perspective view of a frame for use in a method of cooling a heating furnace according to an example of the third embodiment of the present invention.

Then, an example of cooling a heating furnace according to an example of the third embodiment of the present invention is described below by making reference to FIGS. 7, 8(A) and 8(B), as well as 9(A) and 9(B). The present cooling method is applied to a heating furnace 53; a type in which the steel materials to be heated, such as slabs, are transported by using beams 52 comprising fixed beams 50 and walking beams 51 both extended in the longitudinal direction of the furnace and arranged in turns in the lateral direction of the furnace.

Referring to FIGS. 7, 8(A) and 8(B), 9(A) and 9(B), a frame body 54 is used in the present cooling method. The frame body 54 is provided at a size capable of being inserted from the extracting port 53*a* of the heating furnace 53. The frame body 54 comprises longitudinal members 55 consisting of a plurality (specifically in this case, 8 units) of long angular pipes provided in an approximately equi-spaced arrangement in the width direction of the extracting port 53*a*, and lateral members 56 provided on the upper side of the longitudinal members 55 and consisting of a plurality (specifically in this case, 3 units) of long angular pipes extending in the width direction of the furnace, which are provided in an approximately equi-spaced arrangement in the longitudinal direction of the longitudinal members 55 in order to connect them.

Spray nozzles 57 which spray a cooling water in the form of a mist against the scale deposits S inside the hating furnace 53 are provided on the lower side of the position at which the longitudinal members 55 cross the lateral members 56. A cooling water piping 58 and a compressed air piping 59 are inserted into the inside of the longitudinal member 55. Thus, cooling water and compressed air are supplied to the spray nozzle via the cooling water piping 58 and the compressed air piping 59, and cooling water is eventually sprayed as a mist from the spray nozzle 57.

Figure 8:
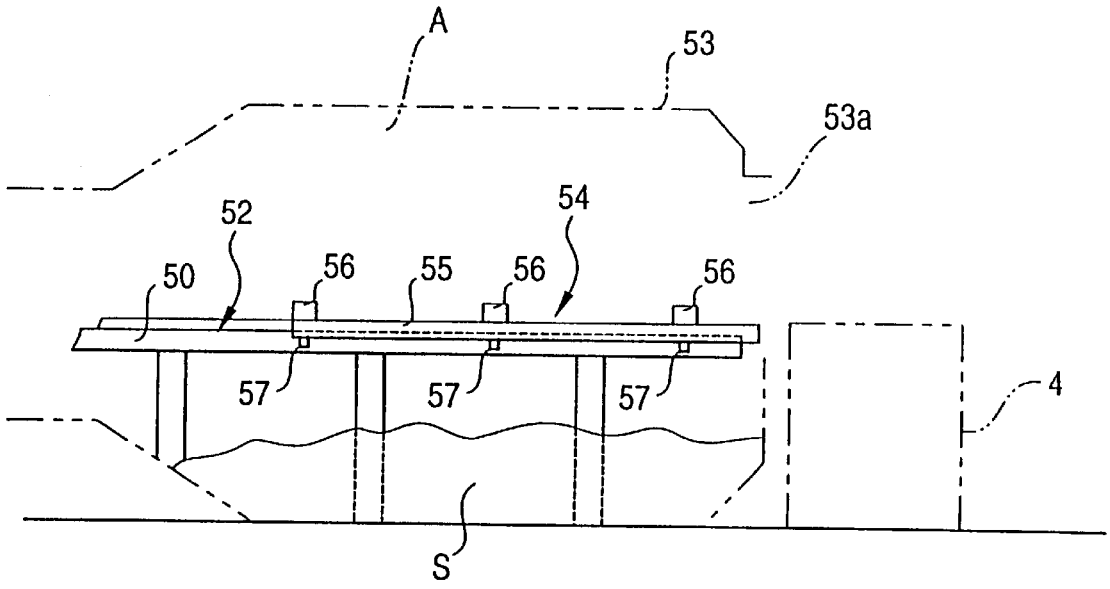
FIGS. 8(A) and 8(B) are each a schematically drawn side view each showing a stage in which a frame is mounted on the beams.
Figure 8:
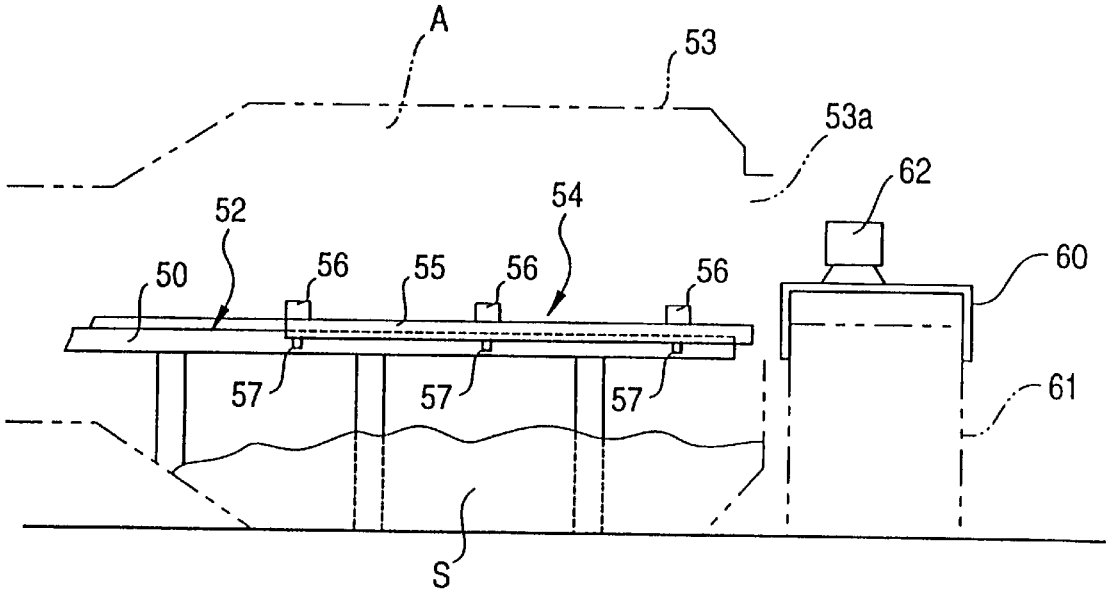
Figure 9:
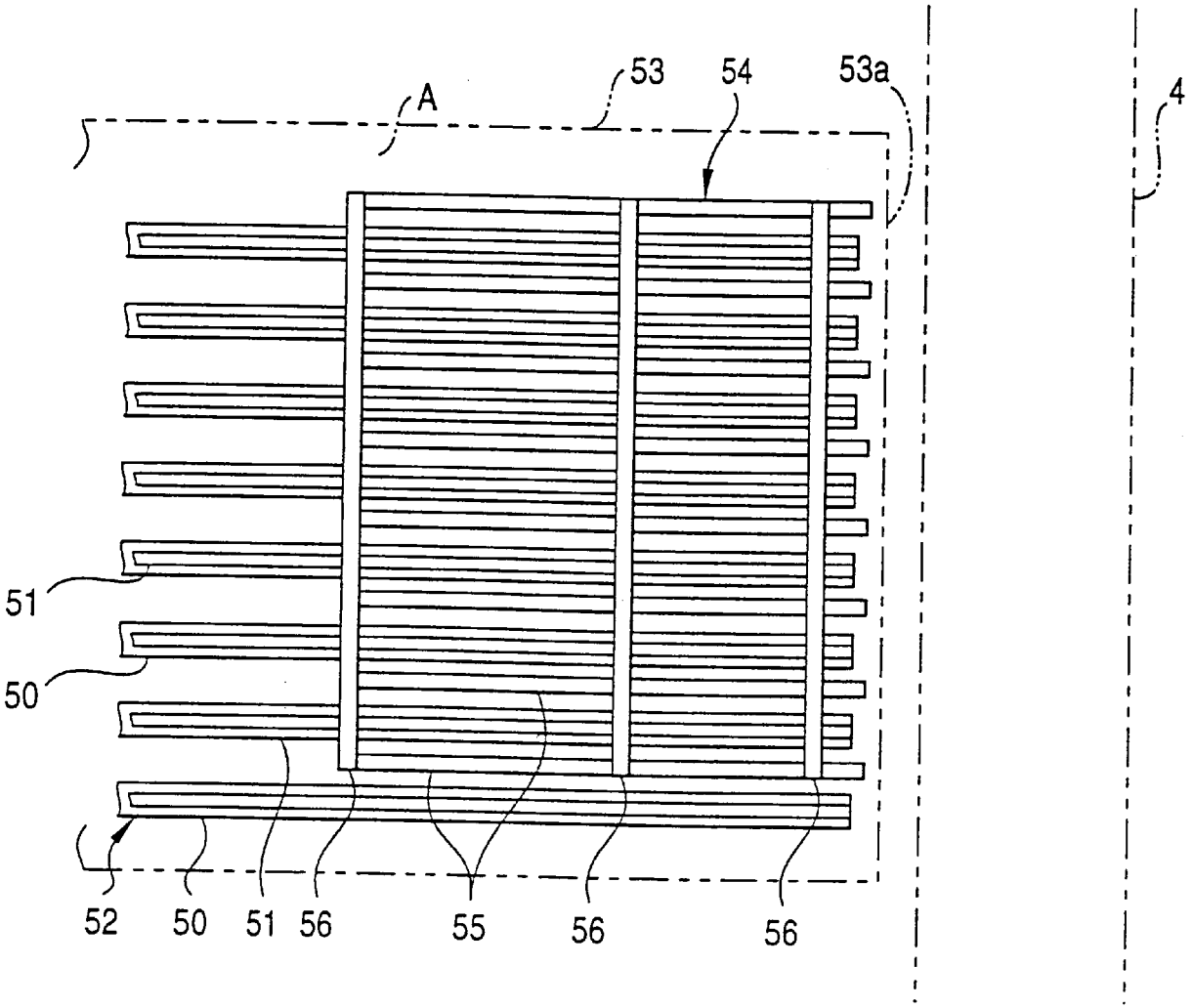
FIGS. 9(A) and 9(B) are each a planar view corresponding to FIGS. 8(A) and 8(B)
Figure 9:
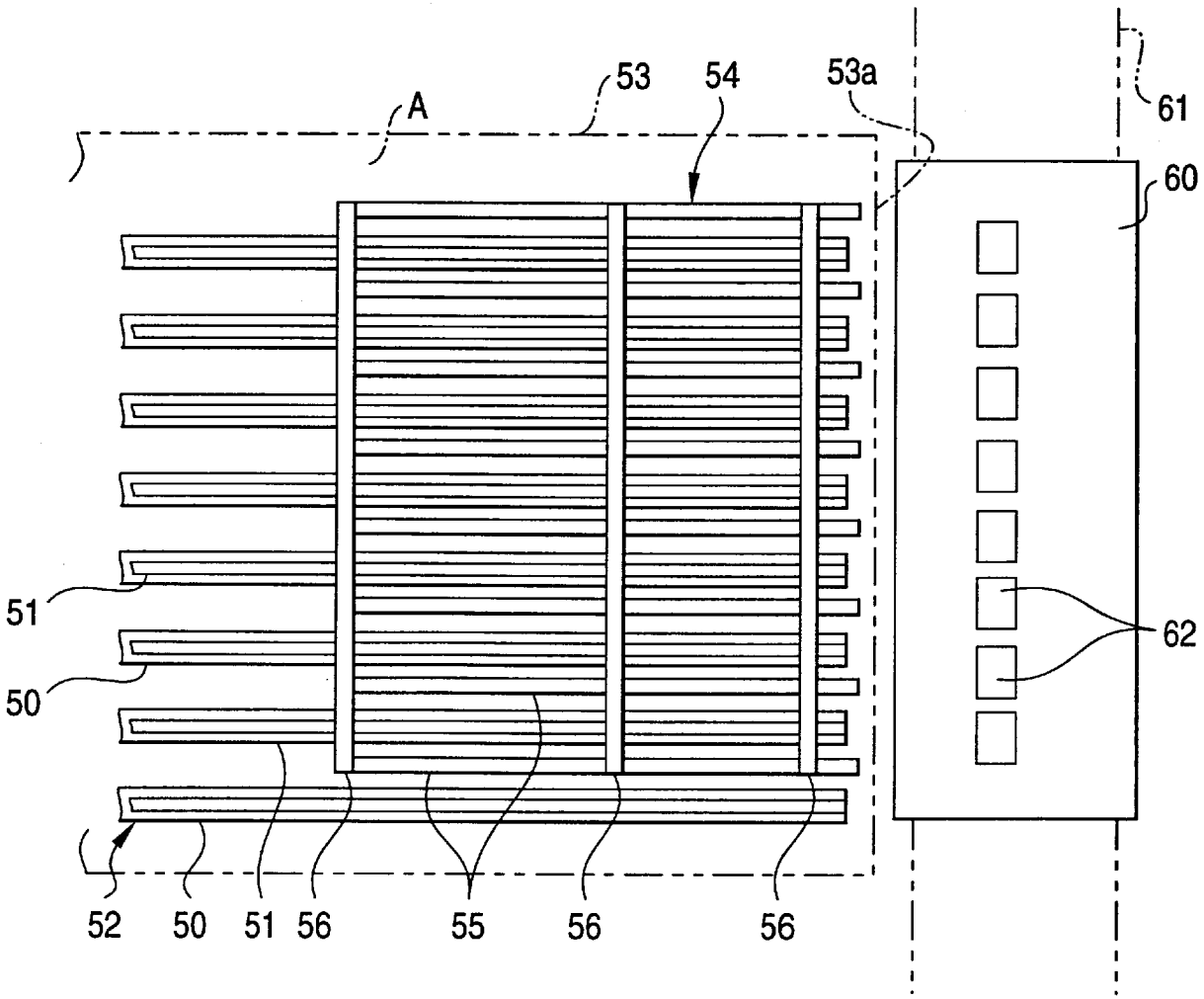

Referring to FIGS. 8(B) and 9(B), a table 60 for setting a cooling fan is provided in the vicinity of the extracting port 53*a* of the heating furnace 53, and the table 60 is attached to a table or the like of a rolling line 61 placed along the width direction of the extracting port 53*a* in the vicinity of the extracting port 53*a*. A plurality (specifically in this case, 8 units) of cooling fans 62 which forcibly supply cooling air into the inside of the heating furnace 53 from the extracting port 53*a* are set approximately equi-spaced in the width direction of the extracting port 53*a*.

Then, in cooling the heating furnace 53 in case the heating furnace 53 is dormant, firstly, the frame body 54 is inserted into the heating furnace 53 from the extracting port 53*a* of the heating furnace 53, and is mounted on the walking beam 51. At this instant, the lateral members 56 of the frame body 54 are mounted on the walking beam 51, and the longitudinal members 55 thereof are placed between neighboring fixed beams 50 and walking beams 51. The spray nozzles 57 are each pointed to the scale deposits S inside the furnace. Then, the walking beams 51 are driven in such a manner that the frame body 54 is reciprocally transported between the soaking zone A and the heating zone (not shown), while cooling water is sprayed against the scale deposits S inside the furnace in the form of a mist consisting of spray particles not larger than 100 $\mu$m in diameter, by supplying cooling water and compressed air to the spray nozzles 57 via cooling water piping 58 and compressed air piping 59.

Furthermore, by using a cooling fan, the cooling fan 62 is driven together with the spraying of cooling water to forcibly supply the cooling air inside the heating furnace. Thus, water vapor concentration inside the furnace is reduced to 30 vol % or lower at the same time with cooling the inside of the heating furnace.

As is clear from the explanations above, the method according to the present embodiment comprises cooling the scale deposits S by spraying cooling water in the form of a mist to the scale S deposited inside the furnace. Thus, the cooling power is not subject to seasonal factors, and moreover, no wetting occurs on the inner furnace refractories.

Accordingly, even in case the temperature of the atmosphere inside the furnace is high, the scale deposits S can be cooled without waiting for the temperature of the atmosphere inside the furnace to drop. Thus, as a result, the period of time necessary for cooling the furnace (the time necessary for cooling the furnace body and the time for cooling the surface of the scale deposits) can be surely shortened.

Furthermore, by supplying cooling air, the water vapor concentration inside the furnace can be reduced to 30 vol % or lower. Thus, this method can be favorably applied to ceramic fiber furnaces.

In addition, because the frame body 54 is reciprocally transported between the soaking zone A and the heating zone while spraying cooling water against the scale deposits S inside the furnace in the form of a mist (consisting of spray particles not larger than 100 $\mu$m in diameter), spray cooling of the scale S over a wide range is enabled. Thus, the cooling time can be further shortened.

In the embodiments described above, cooling is focused on the zone which most suffers from scale deposits, i.e., the soaking zone (the zone in the vicinity of the extracting port) Thus, a uniform cooling time was realized for the entire heating furnace.

ENBODIMENT

Conventional cooling methods I and II, and the method according to the present invention were carried out on a heating furnace 2 (having a soaking zone area of 138.6 $m^2$) shown in FIGS. 5(A), 5(B), 6(A), and 6(B), and the time necessary to achieve an inner furnace temperature of 55° C. or lower and a scale surface temperature of 55° C. or lower was measured in both summer and winter seasons.

Figure 12:
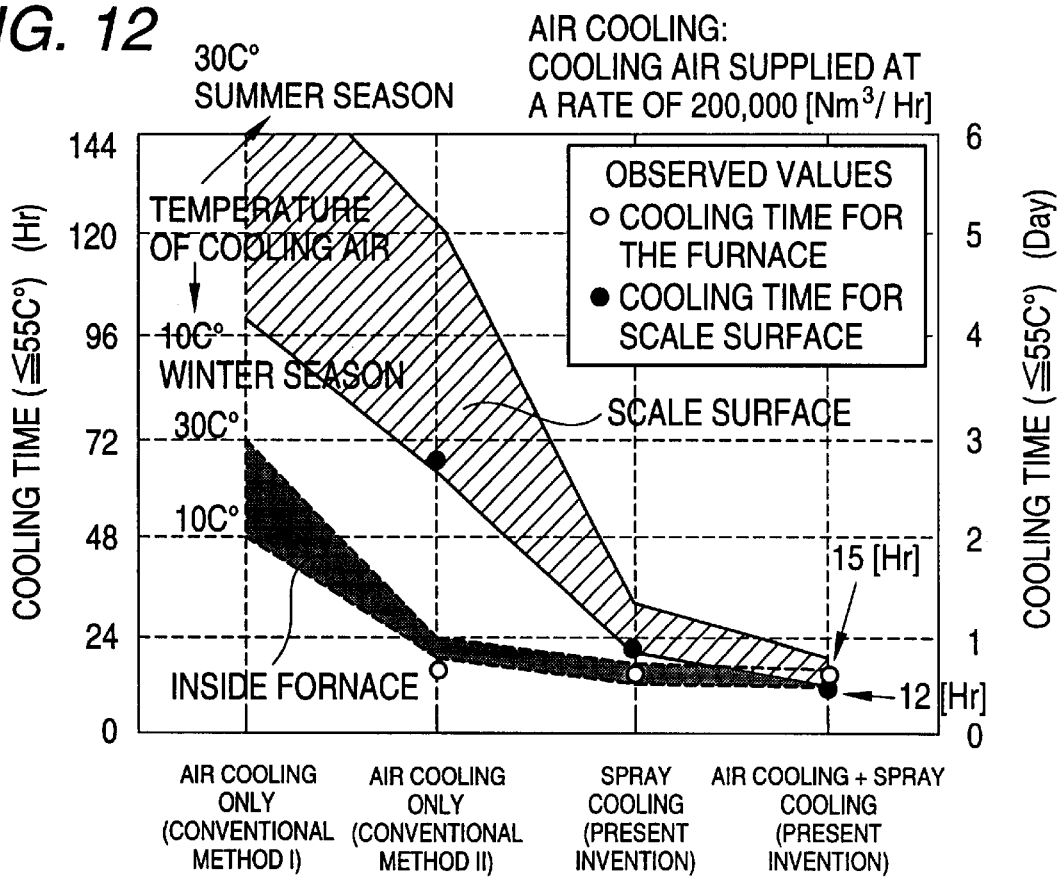
FIG. 12 is a graph showing the difference in cooling time between a prior art method and the method according to the present invention.

The conventional method I comprises supplying cooling air at a rate of 80,000 $Nm^3$/Hr from the extracting port 2*a* into the heating furnace 2 by using a cooling fan. The conventional method II comprises supplying cooling air at a rate of 200,000 $Nm^3$/Hr from the extracting port 2*a* into the heating furnace 2 by using a cooling fan. The spray cooling method according to the present invention comprises supplying cooling water at a rate of 3.5 $m^3$/Hr using a cooling apparatus 1 over a spray cooling area of 138.6 $m^2$, and supplying cooling water at an average spray particle diameter of 30 $\mu$m. Furthermore, together with the spray cooling using lances, cooling air was supplied by using a cooling fan at a rate of 200,000 $Nm^3$/Hr. The experimental results are shown in FIG. 12. FIG. 12 clearly reads that, in case of the conventional method I, a cooling time of 48 hours or more is necessary for cooling the furnace itself and the surface of the scale deposits in both summer and winter seasons. In case of the conventional method II, although the cooling time for the furnace itself fell in a range of from 18 to 24 hours, the time necessary to cool the surface of scale deposits was 65 hours or more.

In contrast to the results above, in case of the method according to the invention in which air cooling and spray cooling are used at the same time, the cooling time for the furnace itself and for the surface of the scale deposits was within 18 hours irrespective of the seasonal differences. In particular, the cooling time for the furnace body was within 15 hours for both summer and winter seasons, and the cooling time for the surface of the scales was within 18 hours for both summer and winter seasons. Moreover, measurement was made on the water vapor concentration inside the furnace to find a maximum value of 2.0 volt. In case spray cooling according to the present invention alone was performed, the cooling time of the furnace body was within 16 hours irrespective of the seasonal differences, and the time of surface cooling the scale deposits was 30 hours in summer and was 20 hours in winter. The water vapor concentration inside the furnace in this case was found to fall in a range of from 40 to 60 volt.

INDUSTRIAL APPLICABILITY

As described above, the invention according to the first aspect of the present invention comprises cooling the scaled deposits inside the furnace by spraying a coolant in the form of a mist. Thus, the cooling power is not subject to seasonal factors; moreover, no wetting occurs on the inner furnace refractories. As a result, even in case the temperature of the atmosphere inside the furnace is high, the scale deposits can be cooled without waiting for the temperature of the atmosphere inside the furnace to drop. This enables cutting out the conventional waiting time necessary for the inner furnace temperature to be sufficiently lowered, and surely shortens the furnace cooling time (the time necessary for cooling the furnace body and the time for cooling the surface of the scale deposits).

In accordance with the second aspect of the present invention, cooling air is forcibly supplied into the heating furnace in addition to the spray cooling according to the first aspect of the present invention. Accordingly, the cooling effect is increased as to surely and sufficiently reduce the furnace cooling time (the time necessary for cooling the furnace body and the time for cooling the surface of the scale deposits). Moreover, the water vapor concentration inside the furnace can be reduced to 30 vol % or lower by supplying the cooling air. Thus, this method can be favorably applied to ceramic fiber furnaces.

According to the third aspect of the present invention, a coolant in the form of a mist is sprayed against the inner furnace scale deposits to cool the scale. Thus, the cooling power is not influenced by seasonal factors; moreover, no wetting occurs on the inner furnace refractories. Furthermore, because a coolant in the form of a mist is sprayed against the scale deposits inside the heating furnace while reciprocally transporting a frame body between the soaking zone and the heating zone, spray cooling of the scales over a wide area is made possible. This furthermore shortens the cooling time.

In the fourth aspect of the present invention, the lances are folded to facilitate the use of the apparatus during the operation of the heating furnace, and when the heating furnace is dormant, the lances can be easily inserted into the furnace by rotating them. Thus, the apparatus is of easy operation in case of carrying out the spray cooling by utilizing the lances.

In accordance with the fifth aspect of the present invention, the cooling fan is provided integrated with the apparatus. Thus, in case of performing spray cooling using the lances while supplying cooling air by using a cooling fan, the apparatus is found to be of easy operation.

According to the sixth aspect of the present invention, not only the effects of the fourth and the fifth aspects of the present invention are achieved, but also an apparatus can be obtained with three or more lances easily arranged in an approximately equi-spaced manner and with their front ends aligned. Thus, a favorable apparatus using three or more lances is readily available.

In accordance with the seventh to ninth aspect of the present invention, spray particles are controlled to have a diameter of 100 $\mu$m or less, or, depending on the inner furnace temperature, to a proper particle diameter which does not cause wetting of the refractories. Thus, damages are prevented from occurring on the refractories, and cooling can be effected in a short period of time.

According to the tenth aspect of the present invention, cooling air is forcibly supplied into the heating furnace in addition to spray cooling. Thus, the cooling effect is increased as to surely and sufficiently reduce the furnace cooling time (the time necessary for cooling the furnace body and the time for cooling the surface of the scale deposits). Moreover, the water vapor concentration inside the furnace can be reduced to 30 vol % or lower by supplying the cooling air. Thus, this method can be favorably applied to ceramic fiber furnaces.

As a result, even in case the temperature of the atmosphere inside the furnace is high, the scale deposits can be cooled without waiting for the temperature of the atmosphere inside the furnace to drop. This enables cutting out the conventional waiting time necessary for the inner furnace temperature to be sufficiently lowered, and surely shortens the furnace cooling time (the time necessary for cooling the furnace body and the time for cooling the surface of the scale deposits).

In the embodiments described above, cooling is focused on the zone which most suffers from scale deposits, i.e., the soaking zone (the zone in the vicinity of the extracting port) Thus, a uniform cooling time was realized for the entire heating furnace. The present invention is applicable to heating furnaces for use in hot rolling, for example, slabs, hot rolled steel sheets, plates, bar steels, etc.

What is claimed is:

1. A method for cooling a heating furnace during the dormant stage of the heating furnace, comprising:

inserting from an extracting port to the inside of the heating furnace, a plurality of lances, being arranged along the width direction of the extracting port of said furnace while taking a predetermined distance between each other; and spraying a coolant in the form of a mist against a scale deposited inside the heating furnace from a plurality of spray nozzles provided on the lances, controlling a concentration by volume of water vapor inside the heating furnace is controlled to be not greater than 30%.

2. A method for cooling a heating furnace as claimed in claim 1, wherein, an additional cooling air is forcibly supplied to the inside of said heating furnace together with the spraying of the coolant in the form of a mist against the scale.

3. A method for cooling a heating furnace as claimed in claim 2, wherein, said heating furnace is a type in which the material to be heated is transported by using fixed beams and walking beams both extended in the longitudinal direction of the furnace and arranged in turns while talking a predetermined distance between each other;

a frame on which said plurality of spray nozzles are provided is inserted into the inside of the heating furnace from the extracting port and mounted on said beams; and said walking beams are driven in such a manner to move said frame reciprocally along the longitudinal direction of the furnace while the coolant in the form of a mist is sprayed from said spray nozzles against the scale deposited inside the furnace.

4. A method for cooling a heating furnace as claimed in claim 2, wherein, the coolant provided in the form of a mist consists of sprayed particles having a particle diameter of 100 $\mu$m or less.

5. A method for cooling a heating furnace as claimed in claim 1, wherein, said heating furnace is a type in which the material to be heated is transported by using fixed beams and walking beams both extended in the longitudinal direction of the furnace and arranged in turns while taking a predetermined distance between each other;

a frame on which said plurality of spray nozzles are provided is inserted into the inside of the heating furnace from the extracting port and mounted on said beams; and said walking beams are driven in such a manner to move said frame reciprocally along the longitudinal direction of the furnace while the coolant in the form of a mist is sprayed from said spray nozzles against the scale deposited inside the furnace.

6. A method for cooling a heating furnace as claimed in claim 1, wherein, the coolant provided in the form of a mist consists of sprayed particles having a particle diameter of 100 $\mu$m or less.

7. A method for cooling a heating furnace as claimed in claim 6, wherein, the particle diameter of the sprayed particles of the coolant provided in the form of a mist is controlled in accordance with the following formula (1):

$$D \leqq 61.255 \cdot 1n\ T - 214.24 \quad (1)$$

where, D represents the particle diameter of the sprayed particles ($\mu$m), and T represents the temperature of the atmosphere inside the furnace (° C.).

8. A method for cooling a heating furnace as claimed in claim 7, wherein, the particle diameter of the sprayed particles of the coolant provided in the form of a mist is reduced with decreasing temperature inside the furnace.

9. A method for cooling a heating furnace as claimed in claim 7, wherein, the particle diameter of the sprayed particles of the coolant provided in the form of a mist is reduced with decreasing temperature inside the furnace.

10. A method for cooling a heating furnace as claimed in claim 1, wherein, said heating furnace is a furnace to re-heat slabs, billets or blooms for use in the hot rolling thereof.

* * * * *